US011586128B2

(12) United States Patent
Okamoto

(10) Patent No.: US 11,586,128 B2
(45) Date of Patent: Feb. 21, 2023

(54) CONDUCTION MECHANISM AND IMAGE FORMING APPARATUS

(71) Applicant: SHARP KABUSHIKI KAISHA, Sakai (JP)

(72) Inventor: Shohtaroh Okamoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/677,318

(22) Filed: Feb. 22, 2022

(65) Prior Publication Data

US 2022/0283528 A1 Sep. 8, 2022

(30) Foreign Application Priority Data

Mar. 2, 2021 (JP) ..... JP2021-032377

(51) Int. Cl.

| | |
|---|---|
| ***G03G 15/00*** | (2006.01) |
| ***G03G 15/09*** | (2006.01) |
| ***G03G 21/16*** | (2006.01) |

(52) U.S. Cl.
CPC ..... *G03G 15/0935* (2013.01); *G03G 21/1652* (2013.01)

(58) Field of Classification Search
CPC . G03G 15/00; G03G 15/0935; G03G 21/1652
USPC ..... 399/107, 110, 111, 117
See application file for complete search history.

(56) References Cited

U.S. PATENT DOCUMENTS 6,275,668 B1 8/2001 Batori

FOREIGN PATENT DOCUMENTS

| | | | |
|---|---|---|---|
| JP | H10240103 | * | 9/1998 |
| JP | H11-338254 A | | 12/1999 |
| JP | 2011175203 | * | 9/2011 |

* cited by examiner

*Primary Examiner* — Hoan H Tran
(74) *Attorney, Agent, or Firm* — ScienBiziP, P.C.

(57) ABSTRACT

A conduction mechanism includes: a conductive bearing that rotatably supports a rotary shaft; a non-conductive axial positioner that has a cylinder externally fitted to the bearing; and a contact terminal attached to an outer circumferential surface side of the cylinder. The cylinder has a slit, and the contact terminal has an abutment piece that is exposed to an inner circumferential surface side of the cylinder from the slit and abuts an outer circumferential surface of the bearing.

9 Claims, 14 Drawing Sheets

CONDUCTION MECHANISM AND IMAGE FORMING APPARATUS

BACKGROUND OF THE INVENTION

Field of the Invention

The present invention relates to a conduction mechanism and an image forming apparatus, in particular, for example, to a conduction mechanism that electrically connects a contact terminal to a rotary shaft and an image forming apparatus including the conduction mechanism.

Description of the Background Art

An example of an image forming apparatus that includes this type of a conventional conduction mechanism is disclosed in Japanese Unexamined Patent Application Publication No. 11-338254. In the technique disclosed in Japanese Unexamined Patent Application Publication No. 11-338254, on an outer circumferential side of a conductive flange (rotary shaft) that is attached to an end of a developing roller, an axial recessed groove is provided to a gear, and an arm of an electrode ring (a contact terminal) is arranged in this recessed groove. A circular plate-shaped first contact of the electrode ring abuts a spring-like arm of a fixed electrode, and the arm abuts a flat plate-shaped notch that is formed on an outer circumferential surface of the flange. In this way, the rotary shaft and the fixed electrode (and thus an apparatus body) are electrically connected via the electrode ring, which allows electricity to be supplied to the developing roller.

In the technique disclosed in Japanese Unexamined Patent Application Publication No. 11-338254, in order to stabilize the contact of the electrode ring, it is necessary to form a plane portion in a contact object (the rotary shaft) by the arm of the electrode ring. In addition, since this electrode ring rotates with the rotary shaft and the first contact thereof slidingly contacts the fixed electrode, a contact portion (a sliding portion) between the first contact and the fixed electrode is possibly scraped, which possibly causes unstable conduction.

Therefore, a main object of the present invention is to provide a novel conduction mechanism and a novel image forming apparatus.

Another object of the present invention is to provide a conduction mechanism and an image forming apparatus capable of securing stable conduction to a rotary shaft.

SUMMARY OF THE INVENTION

The first invention is a conduction mechanism that electrically connects a contact terminal to a rotary shaft. The conduction mechanism includes: a conductive bearing that rotatably supports the rotary shaft; a non-conductive axial positioner that has a cylinder externally fitted to the bearing; and a contact terminal that is attached to an outer circumferential surface side of the cylinder. The axial positioner has a slit that is formed in the cylinder, and the contact terminal has an abutment piece that is exposed to an inner circumferential surface side of the cylinder from the slit and abuts an outer circumferential surface of the bearing.

According to the first invention, the abutment piece of the contact terminal is brought into contact with the outer circumferential surface of the bearing through the slit that is formed in the cylinder of the axial positioner. In this way, it is possible to secure high positioning accuracy of the contact terminal and thus to secure stable conduction to the rotary shaft without performing special processing on the bearing as a contact object by the contact terminal.

In addition, since the abutment piece of the contact terminal is brought into contact with the outer circumferential surface of the bearing and a sliding portion in the conduction mechanism serves as a contact surface between the rotary shaft and the bearing, a problem of scraping of the sliding portion can be solved, and the stable conduction to the rotary shaft can be secured.

The second invention belongs to the first invention and in which the axial positioner has a pair of the slits that are formed at mutually opposing positions across an axial center of the cylinder, and the contact terminal has a pair of the abutment pieces respectively arranged to the pair of the slits.

The third invention belongs to the first or second invention and in which the axial positioner has an annular butting member that is formed to expand outward from an outer circumferential surface at a base end of the cylinder, and the contact terminal has an annular plate that abuts the butting member.

The fourth invention belongs to the third invention and in which the contact terminal has an arm that extends in an axial direction of the cylinder from an inner circumferential surface of the annular plate and is formed to be elastically deformable in a direction that intersects an axial direction with respect to the annular plate, and the abutment piece extends from the arm toward the axial center side of the cylinder.

The fifth invention belongs to the fourth invention and in which the arm is formed with the plural abutment pieces at predetermined intervals in a circumferential direction of the cylinder.

The sixth invention belongs to the fourth or fifth invention and includes an outer fitter that is externally fitted to the cylinder, and the outer fitter has an opening restrictor that is formed on an inner circumferential surface of the outer fitter and restricts outward opening of the arm.

The seventh invention belongs to the sixth invention and in which the outer fitter has a removal restrictor that is formed on an end surface of the outer fitter on a side opposing the annular plate and restricts movement of the annular plate in a removal direction.

The eighth invention belongs to any one of the third to seventh inventions and in which the contact terminal has a retaining projection that is projected from the inner circumferential surface of the annular plate and is pressed against the outer circumferential surface of the cylinder.

The ninth invention is an image forming apparatus that includes the conduction mechanism according to any one of the first to eighth inventions.

According to the present invention, the abutment piece of the contact terminal is brought into contact with the outer circumferential surface of the bearing from the slit that is formed in the cylinder of the axial positioner. In this way, it is possible to secure the high positioning accuracy of the contact terminal and thus to secure the stable conduction to the rotary shaft without performing the special processing on the bearing as the contact object by the contact terminal.

In addition, since the abutment piece of the contact terminal is brought into contact with the outer circumferential surface of the bearing and the sliding portion in the conduction mechanism serves as the contact surface between the rotary shaft and the bearing, the problem of scraping of the sliding portion can be solved, and the stable conduction to the rotary shaft can be secured.

The above-described objects, other objects, features, and advantages of the present invention will become more apparent from the detailed description of the following embodiment given with reference to the drawings.

DESCRIPTION OF THE PREFERRED EMBODIMENTS

Figure 1:
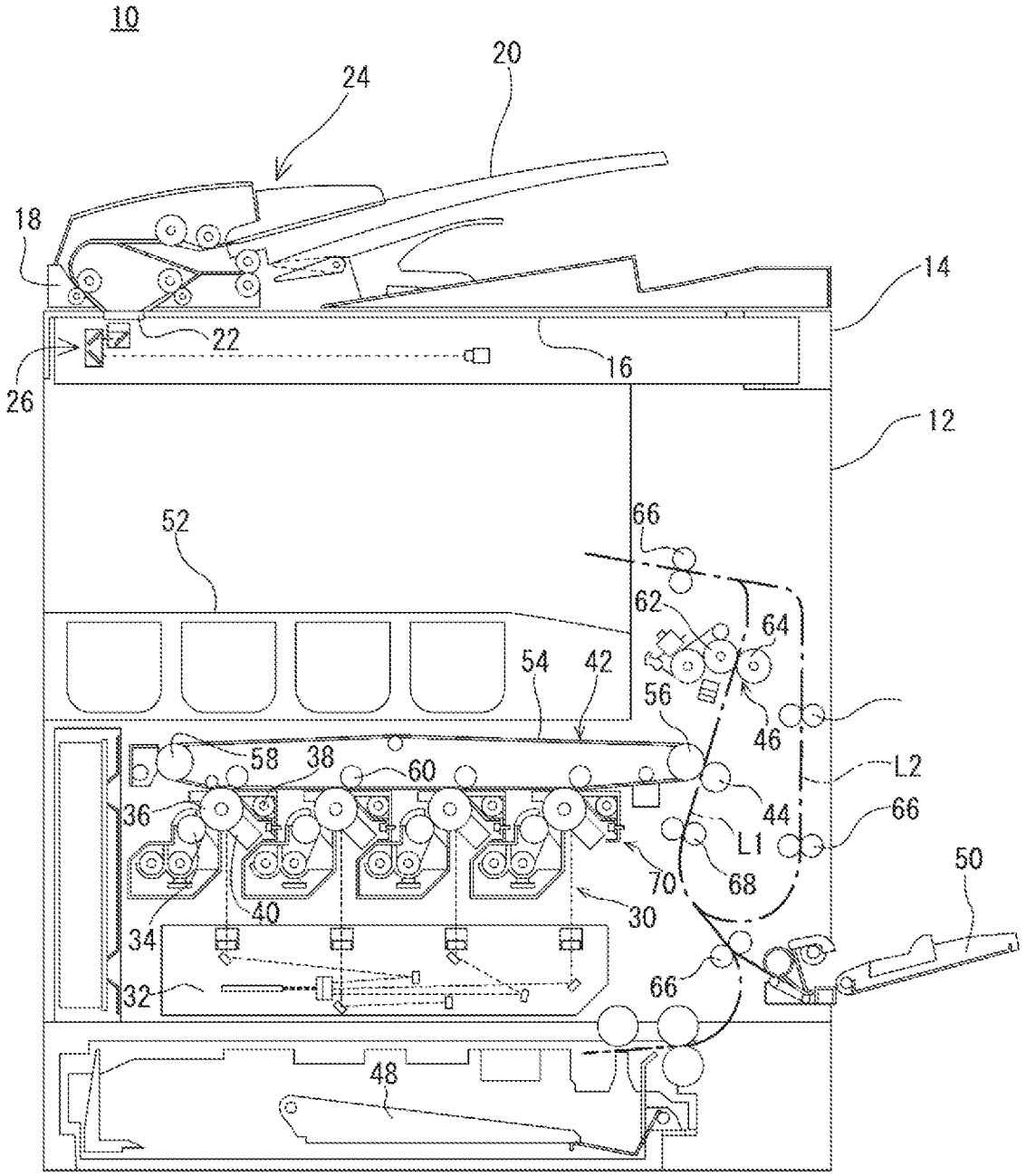
FIG. 1 is a schematic cross-sectional view illustrating an internal structure of an image forming apparatus in an embodiment of the present invention.
Figure 15:
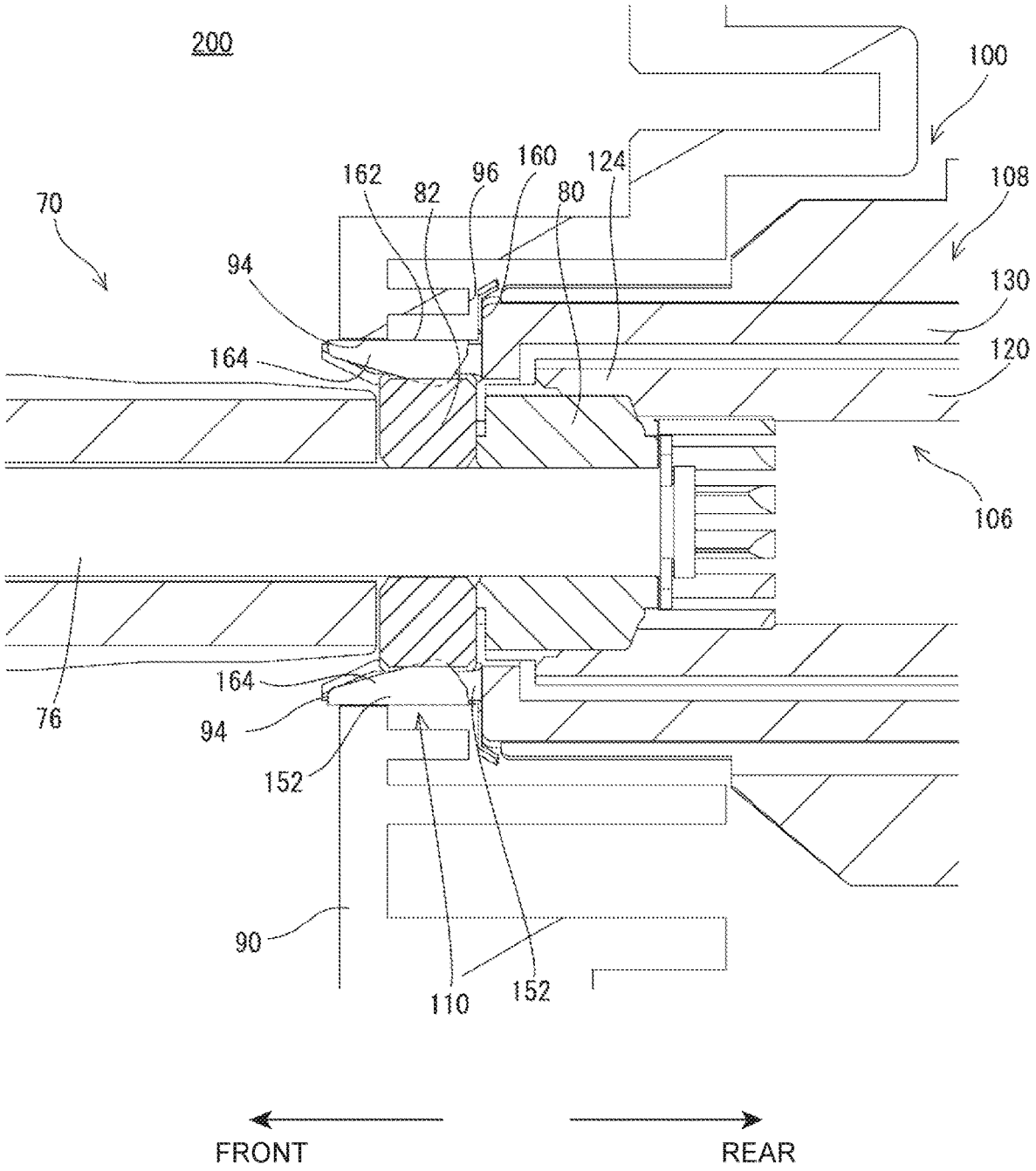
FIG. 15 is a cross-sectional view illustrating a state where a drum shaft and the contact terminal are electrically connected via a bearing.

With reference to FIG. 1, an image forming apparatus 10 as an embodiment of the present invention is a multifunction peripheral (MFP) having a copier function, a printer function, a scanner function, a facsimile function, and the like, and forms a multicolor image or a monochromatic image on paper (a recording medium) by an electrophotographic method. As will be described in detail below, the image forming apparatus 10 includes a conduction mechanism 200 (see FIG. 15) that electrically connects a contact terminal 110, which is provided to an apparatus body 12, to a drum shaft 76 as an example of the rotary shaft in a photoreceptor drum 36. In this image forming apparatus 10, a bearing (a second bearing 82) is used as one of conductive members constituting the conduction mechanism 200. Through this conduction mechanism 200, an electric charge retained in the photoreceptor drum 36 is released to the apparatus body 12 side.

A brief description will firstly be made on a basic configuration of the image forming apparatus 10. In this embodiment, a front-rear direction (a depth direction) of the image forming apparatus 10 and components thereof is defined with a surface opposing a standing position of a user who operates the image forming apparatus 10, that is, a surface on a side where an operation panel 28 (see FIG. 2) is provided being a front surface (front). In addition, a right-left direction (a lateral direction) of the image forming apparatus 10 and the components thereof is defined with a state where the image forming apparatus 10 is seen from the front being a reference.

Figure 2:
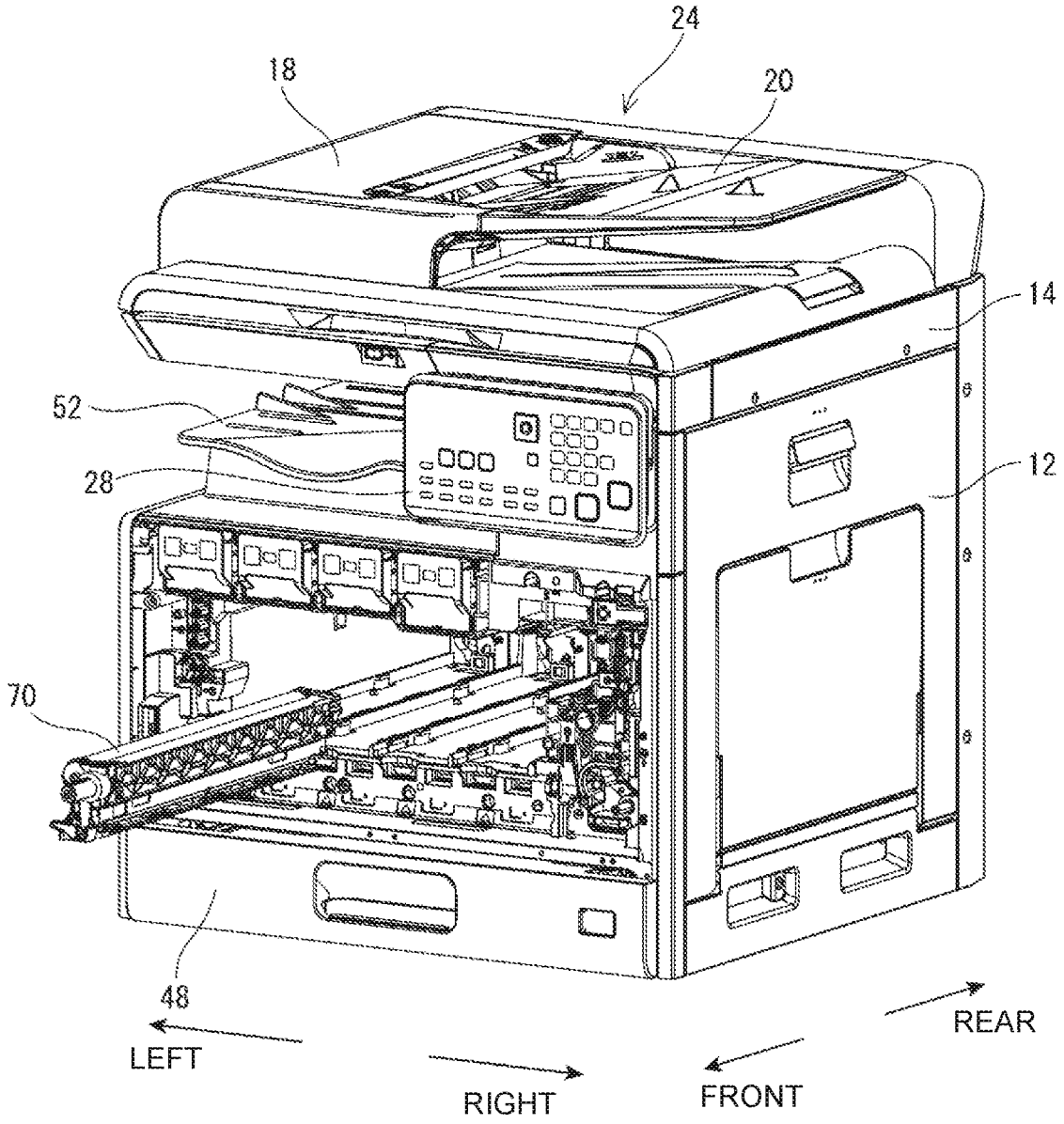
FIG. 2 is a view illustrating a situation where a process unit is attached to an apparatus body.

As illustrated in FIG. 1 and FIG. 2, the image forming apparatus 10 includes: the apparatus body 12 including an image forming device 30 and the like; and an image reading device 14 arranged on top of the apparatus body 12.

The image reading device 14 includes a document table 16 that is made of a transparent material. A document pressing cover 18 is attached in a freely openable/closable manner onto the document table 16 via a hinge and the like. This document pressing cover 18 is provided with an automatic document feeder (ADF) 24 that automatically feeds, per sheet, documents placed on a document tray 20 to an image reading position 22. On the front surface side of the document table 16, the operation panel 28 is provided to accept the user's input operation such as a print instruction. This operation panel 28 is appropriately provided with a display, operation buttons, and the like.

An image reader 26 that includes a light source, plural mirrors, an imaging lens, a line sensor, and the like is installed in the image reading device 14. The image reader 26 exposes a document surface to the light source, and leads reflected light, which is reflected from the document surface, to the imaging lens by using the plural mirrors. Then, the reflected light is imaged on a light receiving element of the line sensor by the imaging lens. The line sensor detects luminance and chromaticity of the reflected light that is imaged on the light receiving element. In this way, image data that is based on an image on the document surface is generated. As the line sensor, a charge-coupled device (CCD), a contact image sensor (CIS), or the like is used.

The apparatus body 12 accommodates a controller (not illustrated), the image forming device 30, and the like, and the controller includes a CPU, memory, and the like. In response to the input operation on the operation panel 28, or the like, the controller sends a control signal to each component in the image forming apparatus 10 and causes the image forming apparatus 10 to perform various types of operation.

The image forming device 30 includes an exposure unit 32, a developing device 34, the photoreceptor drum 36, a cleaner unit 38, a charger 40, an intermediate transfer belt unit 42, a secondary transfer roller 44, a fusing unit 46, and the like, forms an image on paper that is advanced from a paper feed tray 48 or a manual paper feed tray 50, and discharges the image-formed paper into an output tray 52. As the image data used to form the image on the paper, image data read by the image reader 26, image data sent from an external computer, or the like is used.

The image data handled by the image forming apparatus 10 correspond to a color image in four colors including black (K), cyan (C), magenta (M), and yellow (Y). Accordingly, four each of the developing devices 34, the photoreceptor drums 36, the cleaner units 38, and the chargers 40 are provided to form four types of latent images corresponding to the four colors, and these constitute four image stations. In addition, the photoreceptor drum 36, the cleaner unit 38, and the charger 40 are unitized to constitute a process unit 70. In other words, the image forming device 30 is provided with the four process units 70, each of which includes the photoreceptor drum 36, the cleaner unit 38, the charger 40, and the like. The process units 70 can separately be detached from the front surface side of the apparatus body 12.

Figure 13:
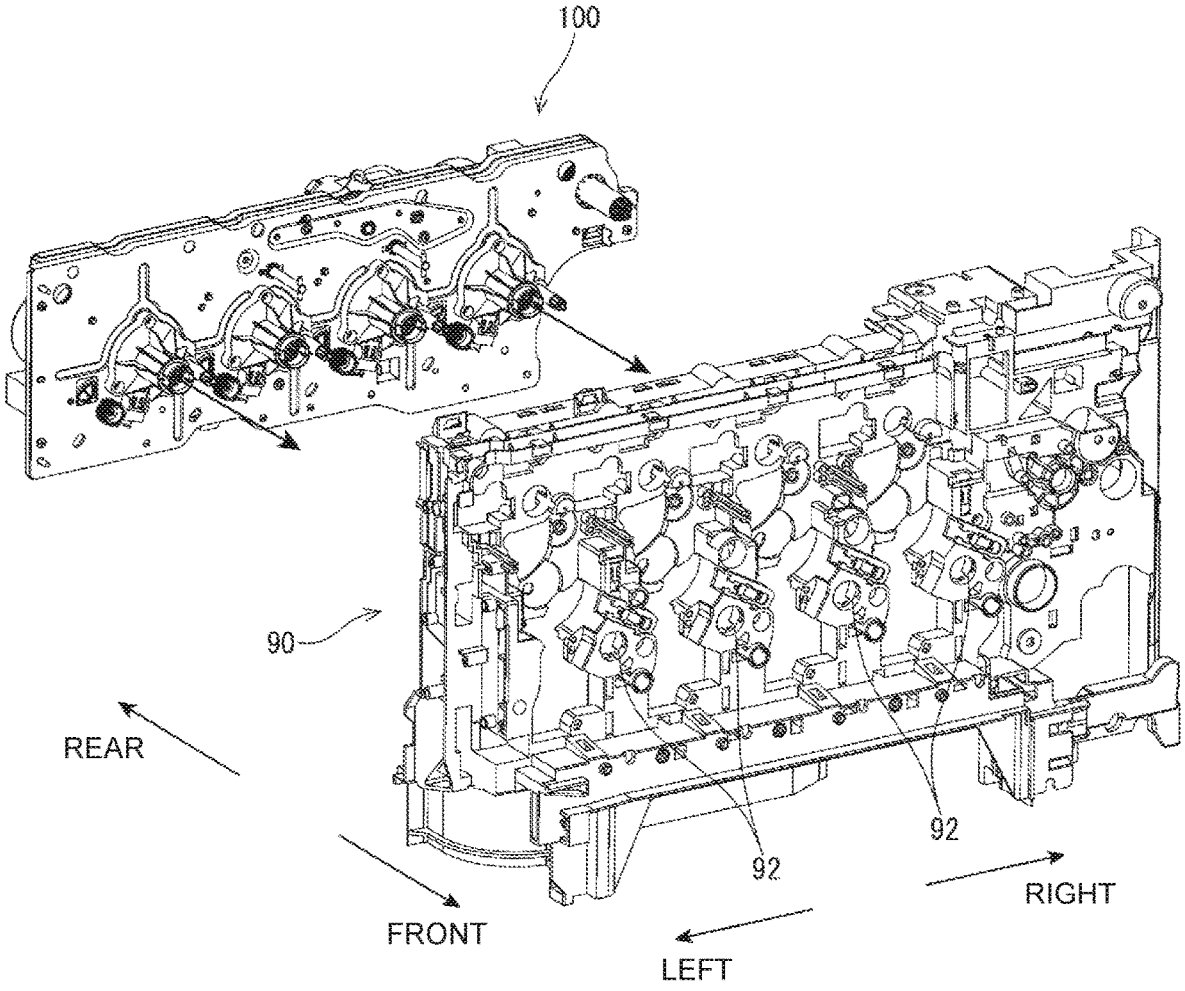
FIG. 13 is a view illustrating a situation where the process unit drive device is attached to a body frame.

In the apparatus body 12, a process unit drive device 100 is fixedly provided to a body frame 90 that is provided on a back surface side (see FIG. 13). When the process unit 70 is attached to the apparatus body 12, the process unit 70 is coupled to the process unit drive device 100, and the respective photoreceptor drum 36 can receive rotary drive power from the process unit drive device 100. In addition, the drum shaft 76 of the photoreceptor drum 36 and the contact terminal 110 provided to the process unit drive device 100 are electrically connected via the second bearing 82 (see FIG. 15). Specific configurations of the process unit 70 and the process unit drive device 100 will be described below.

The photoreceptor drum 36 is an image carrier in which a photosensitive layer is formed on a surface of a conductive cylindrical base body 74, and the charger 40 is a member that charges a surface of this photoreceptor drum 36 to a predetermined potential. The exposure unit 32 is configured as a laser scanning unit (LSU) that includes a laser emitter, a reflection mirror, and the like, and forms an electrostatic latent image corresponding to the image data on the surface of the photoreceptor drum 36 by exposing the surface of the charged photoreceptor drum 36. The developing device 34 visualizes the electrostatic latent image, which is formed on the surface of the photoreceptor drum 36, by using toners in four colors (Y, M, C, and K). The cleaner unit 38 includes a cleaning blade and the like, and removes a matter such as the residual toner on the surface of the photoreceptor drum 36.

The intermediate transfer belt unit 42 includes an intermediate transfer belt 54, a drive roller 56, a driven roller 58, four intermediate transfer rollers 60, and the like, and are arranged above the photoreceptor drum 36. The intermediate transfer belt 54 is provided to contact each of the photoreceptor drums 36. The intermediate transfer roller 60 is used to successively superpose, on the intermediate transfer belt 54, toner images, each of which is formed on the respective photoreceptor drum 36 and has the respective color, and a multicolor toner image is thereby formed on the intermediate transfer belt 54. The secondary transfer roller 44 is arranged near the drive roller 56. When the paper passes through a nip area between the intermediate transfer belt 54 and the secondary transfer roller 44, the toner image formed on the intermediate transfer belt 54 is transferred to the paper.

The fusing unit 46 includes a heating roller 62 and a pressure roller 64, and is arranged above the secondary transfer roller 44. The heating roller 62 is set to be at a predetermined fusing temperature. When the paper passes through a nip area between the heating roller 62 and the pressure roller 64, the toner image that has been transferred to the paper is melted, mixed, and pressed, and the toner image is thus thermally fused to the paper.

In such an apparatus body 12, a first paper advancement path L1 is formed to advance the paper from the paper feed tray 48 or the manual paper feed tray 50 to the output tray 52 through a paper stop roller 68, the secondary transfer roller 44, and the fusing unit 46. A second paper advancement path L2 is also formed to return the paper, which has passed through the fusing unit 46 after single-sided printing, to an upstream side of the secondary transfer roller 44 in a paper advancing direction in the first paper advancement path L1 when double-sided printing is performed on the paper. In these first paper advancement path L1 and second paper advancement path L2, plural advancement rollers 66 are appropriately provided to apply a propulsive force to the paper.

When single-sided printing (image formation) is performed in the apparatus body 12, the paper is led per sheet from the paper feed tray 48 or the manual paper feed tray 50 to the first paper advancement path L1, and is then advanced to the paper stop roller 68 by the advancement rollers 66. Then, the paper stop roller 68 advances the paper to the secondary transfer roller 44 at timing at which a tip of the paper matches a tip of image information on the intermediate transfer belt 54, and the toner image is transferred onto the paper. Thereafter, the unfused toner on the paper is melted and fused by heat when passing through the fusing unit 46, and the paper is then discharged onto the output tray 52.

Meanwhile, in the case where double-sided printing is performed, at the time when a rear end of the paper that has passed through the fusing unit 46 for single-sided printing reaches the advancement roller 66 near the output tray 52, this advancement roller 66 reversely rotates to cause the paper to travel reversely to the second paper advancement path L2. The paper that has been led to the second paper advancement path L2 is advanced through the second paper advancement path L2, and is then led to the upstream side of the paper stop roller 68 in the paper advancing direction in the first paper advancement path L1. Since front and back surfaces of the paper are inverted at this time point, printing is thereafter performed on the back surface of the paper at the time when the paper passes through the secondary transfer roller 44 and the fusing unit 46.

Figure 3:
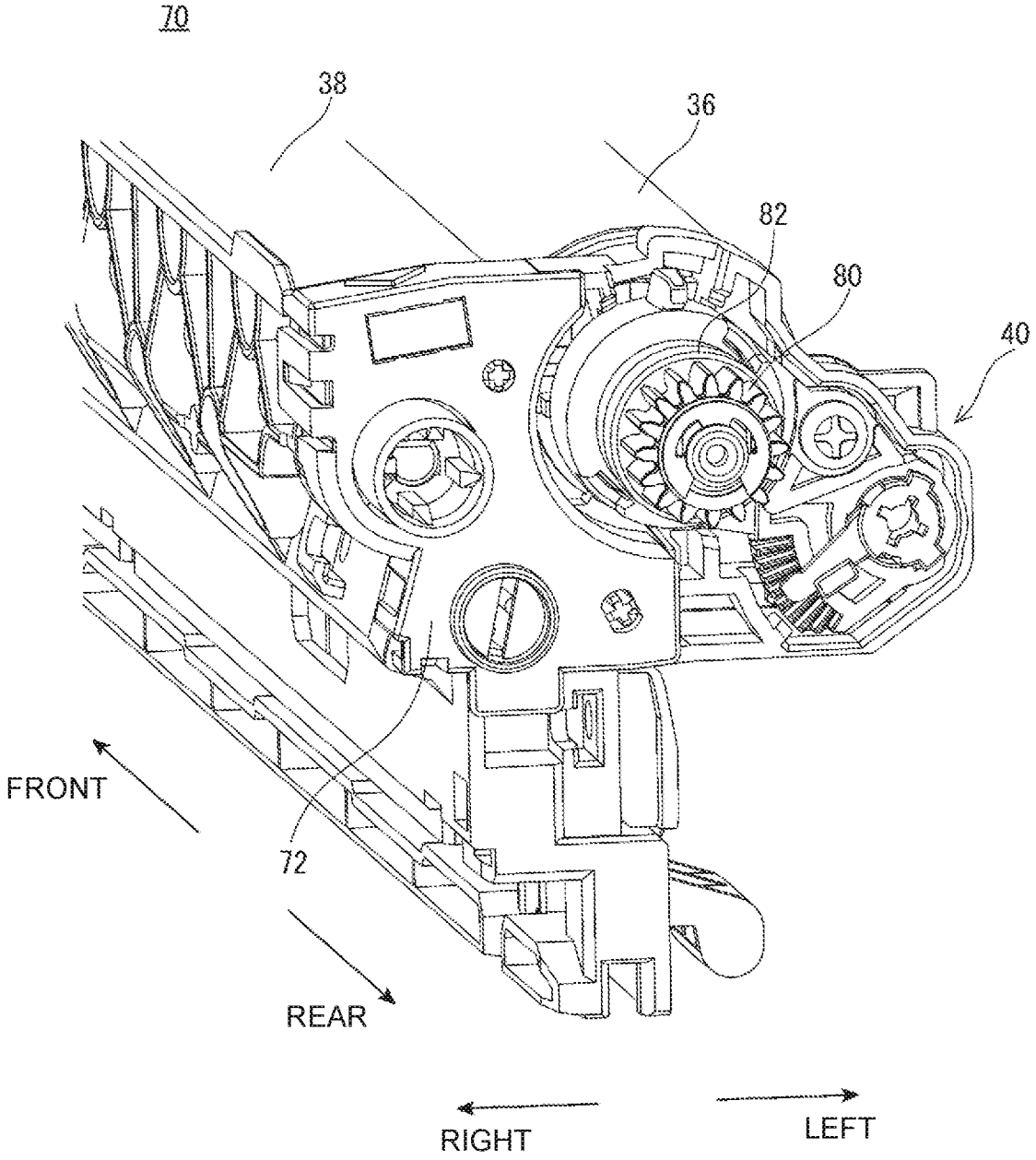
FIG. 3 is a perspective view illustrating a rear end of the process unit.

Next, a description will be made on the configuration of the process unit 70 with reference to FIG. 2 to FIG. 4. As illustrated in FIG. 2 and FIG. 3, the process unit 70 includes the photoreceptor drum 36, the cleaner unit 38, the charger 40, and the like, which are integrally held in a predetermined arrangement manner by a process unit frame 72. The process unit 70 can be detached from a front side of the apparatus body 12, and is attached to the apparatus body 12 or detached from the apparatus body 12 when sliding in the depth direction (the front-rear direction) of the apparatus body 12.

Figure 4:
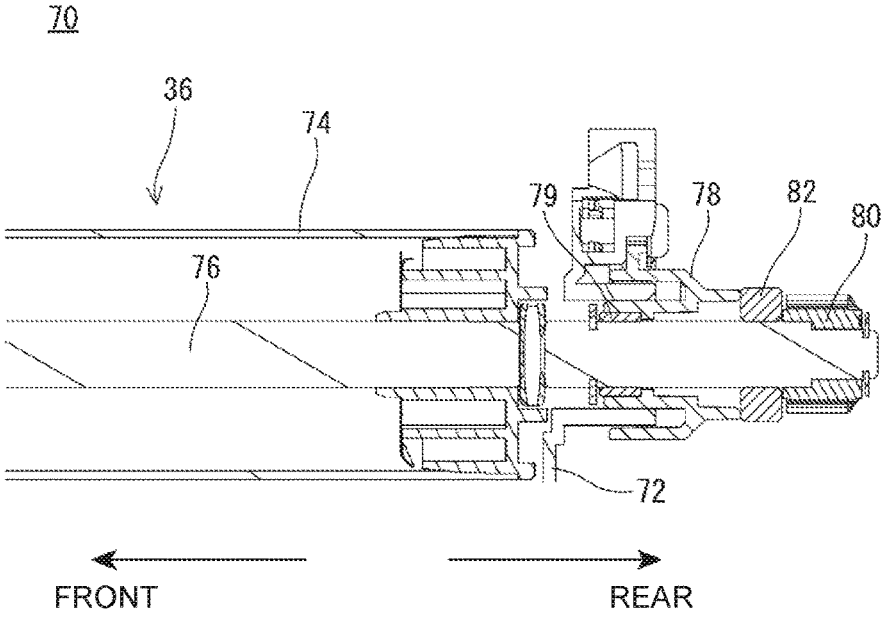
FIG. 4 is a cross-sectional view illustrating the rear end of the process unit.

As illustrated in FIG. 4, the photoreceptor drum 36 includes: the cylindrical base body 74, a surface of which is formed with the photosensitive layer; and a metal (that is, conductive) drum shaft 76 provided to penetrate an axial center of the base body 74. Each end of the drum shaft 76 is rotatably supported by a first bearing 79 that is provided to an end cover member 78 attached to the process unit frame 72, and the base body 74 rotates in conjunction with rotation of this drum shaft 76.

In addition, a photoreceptor coupling 80 having external teeth is provided on an outer surface at a rear end of the drum shaft 76. The photoreceptor coupling 80 is detachably fitted (coupled) to a drive coupling 124 provided to a drum drive gear 106, which will be described below, and transmits rotary drive power of the drum drive gear 106 to the photoreceptor drum 36.

Furthermore, on the outer surface at the rear end of the drum shaft 76, the second bearing 82 is provided between the first bearing 79 and the photoreceptor coupling 80. The second bearing 82 is a slide bearing that is made of sintered metal having conductivity. When the process unit 70 is attached to the apparatus body 12, this second bearing 82 is fitted to a drum shaft positioner 150 formed in a support holder 108, which will be described below. In this way, the second bearing 82 rotatably supports the drum shaft 76 and is used to position the process unit 70 (axially align the photoreceptor drum 36).

In this embodiment, when being fitted to the drum shaft positioner 150, the second bearing 82 comes into contact with an abutment piece 166 of the contact terminal 110, which will be described below, and thereby electrically connects the drum shaft 76 and the contact terminal 110. That is, the second bearing 82 is used as one of the conductive members constituting the conduction mechanism 200 to ground the drum shaft 76, and the drum shaft 76 and the contact terminal 110 are electrically connected via the second bearing 82.

Figure 5:
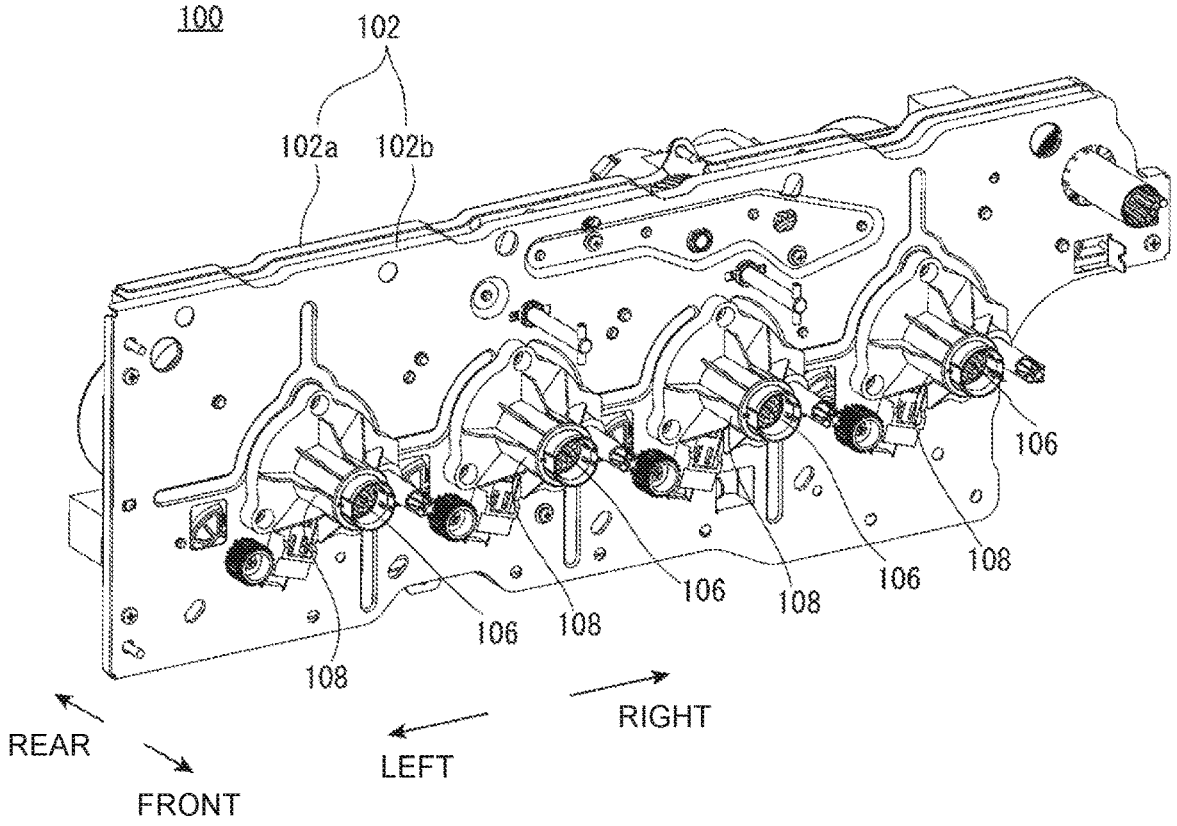
FIG. 5 is a perspective view illustrating a process unit drive device provided in the apparatus body.
Figure 6:
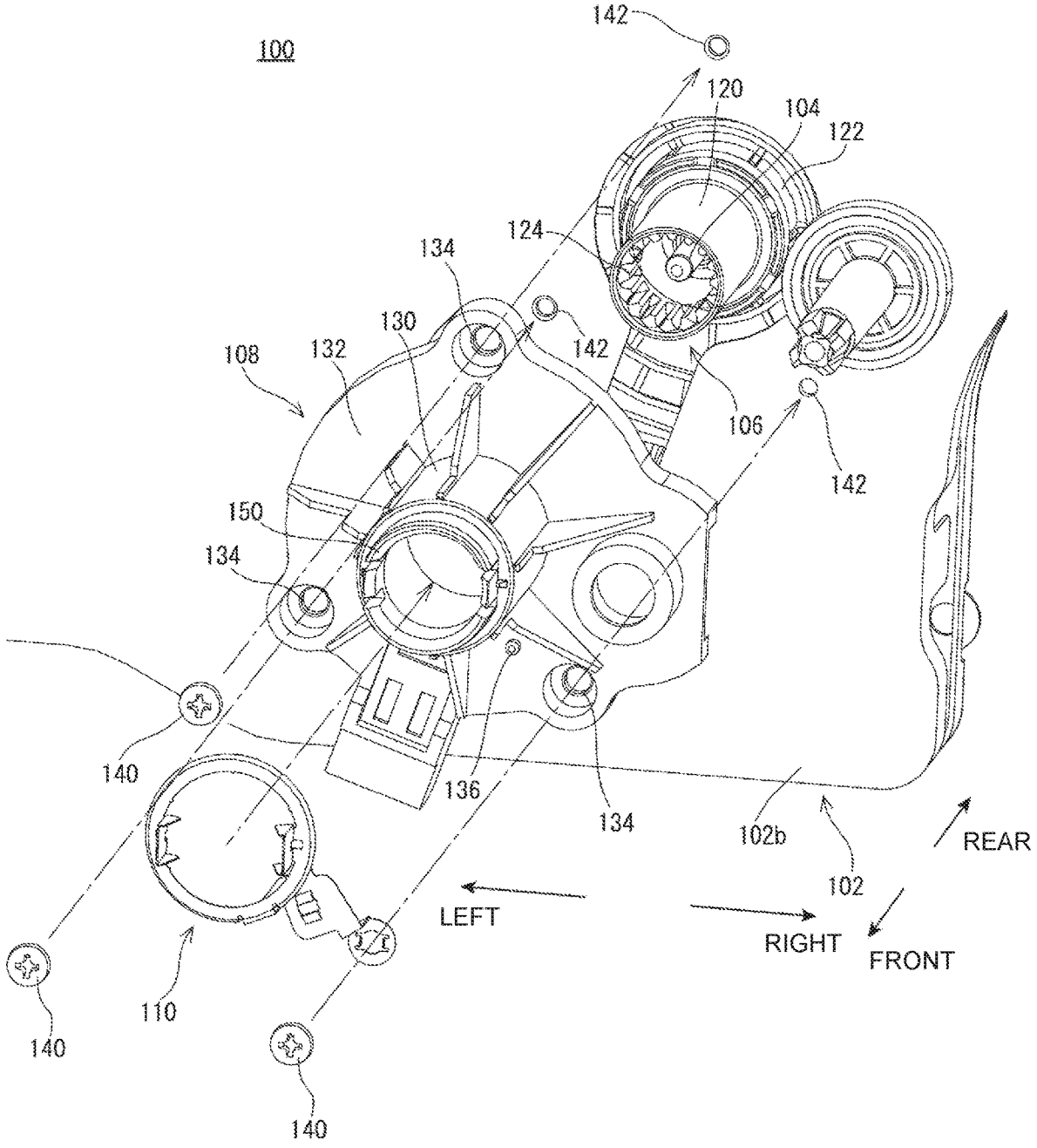
FIG. 6 is an exploded perspective view illustrating peripheral components of a support holder in the process unit drive device.
Figure 7:
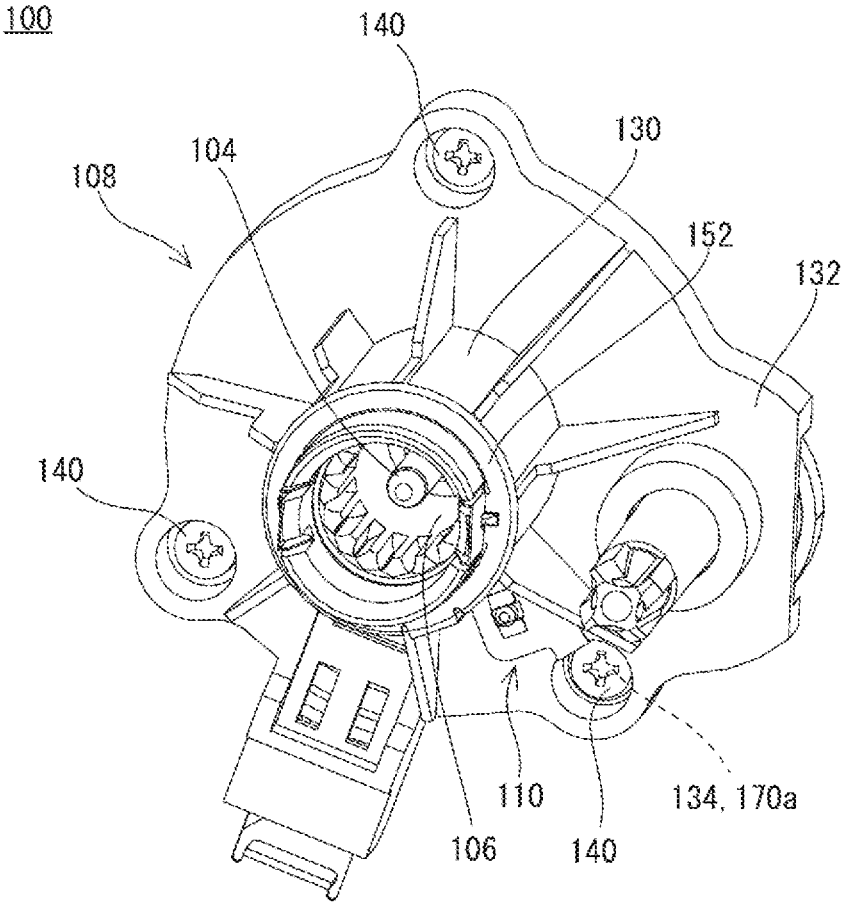
FIG. 7 is a perspective view illustrating the peripheral components of the support holder in the process unit drive device.

Next, a description will be made on the configuration of the process unit drive device 100 with reference to FIG. 5 to FIG. 7. As illustrated in FIG. 5 to FIG. 7, the process unit drive device 100 includes a drive device frame 102, a gear support shaft 104, the drum drive gear 106, the support holder 108, the contact terminal 110, and the like. As described above, the process unit drive device 100 is fixedly provided to the body frame 90 on the back surface side of the apparatus body 12, and applies the rotary drive power to each of the photoreceptor drums 36. Accordingly, four each of the drum drive gears 106 the support holders 108, and the contact terminals 110 are provided in a manner corresponding to the four photoreceptor drums 36 (process units 70), and are held in a predetermined arrangement manner by the drive device frame 102.

The drive device frame 102 is made of conductive metal, and includes: an outer plate 102*a* that is arranged on the back surface side; and an inner plate 102*b* that is arranged on a front side of the outer plate 102*a* with a predetermined distance being provided therefrom.

A drive motor (not illustrated) is provided on a back surface side of the outer plate 102*a*. A motor shaft of the drive motor is provided to be projected forward from the outer plate 102*a*. The outer plate 102*a* is also provided with the gear support shaft 104 that rotatably supports the drum drive gear 106. Rotary drive power from the drive motor is transmitted to the drum drive gear 106 via an appropriate idle gear, and is then transmitted from this drum drive gear 106 to the drum shaft 76 of the photoreceptor drum 36 via the couplings (the drive coupling 124 and the photoreceptor coupling 80).

The drum drive gear 106 includes a boss 120, a gear 122, the drive coupling 124, and the like, which are integrally molded using a non-conductive synthetic resin or the like. The boss 120 is formed in a substantially cylindrical shape and, on a base (a rear end) thereof, is formed with the disc-shaped gear 122 having external teeth. In addition, the drive coupling 124 having internal teeth is formed at a tip (a front end) of the boss 120. As described above, the drive coupling 124 is detachably fitted to the photoreceptor coupling 80 that is attached to the drum shaft 76 of the photoreceptor drum 36. Furthermore, a shaft hole is formed in the boss 120 of the drum drive gear 106. When the gear support shaft 104 is inserted in this shaft hole, the drum drive gear 106 is rotatably supported on the gear support shaft 104.

The drum drive gear 106 as described above is arranged such that a rear portion thereof including the gear 122 is accommodated between the outer plate 102*a* and the inner plate 102*b* and that a front portion thereof including the drive coupling 124 is projected forward from the inner plate 102*b*. Then, the support holder 108 is provided to the inner plate 102*b* so as to cover a projected portion of this drum drive gear 106 from the inner plate 102*b*. A specific description will hereinafter be made on a configuration of the support holder 108.

Figure 8:
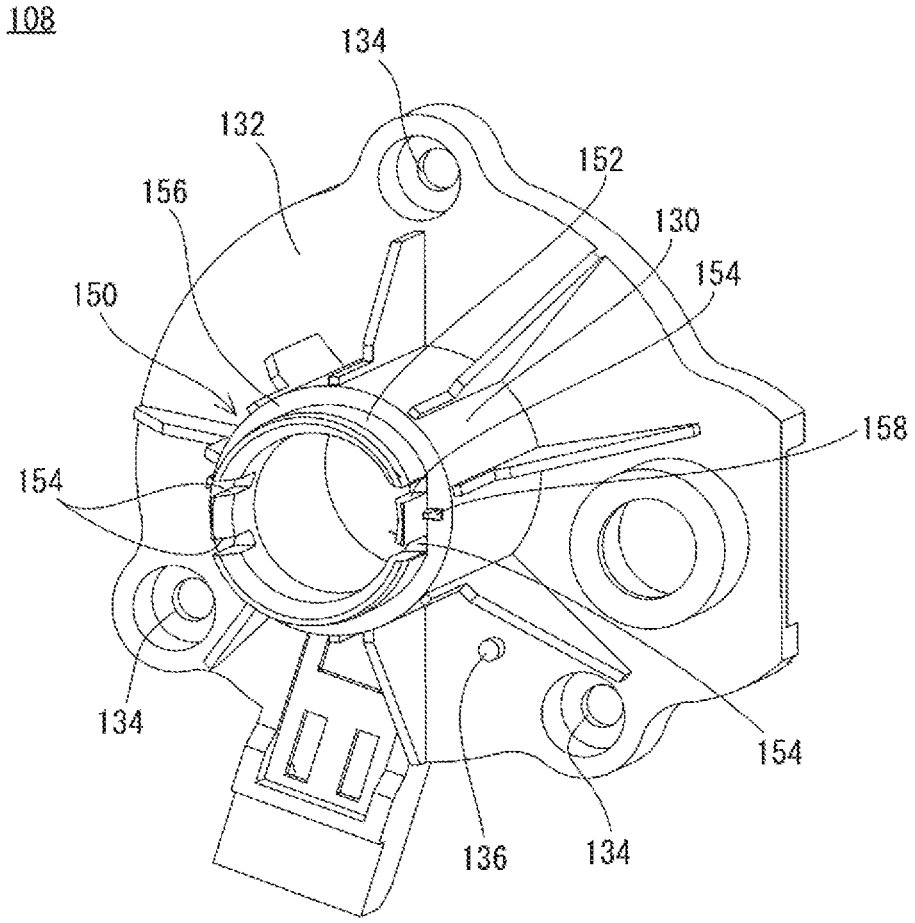
FIG. 8 is a perspective view illustrating a support holder.
Figure 9:
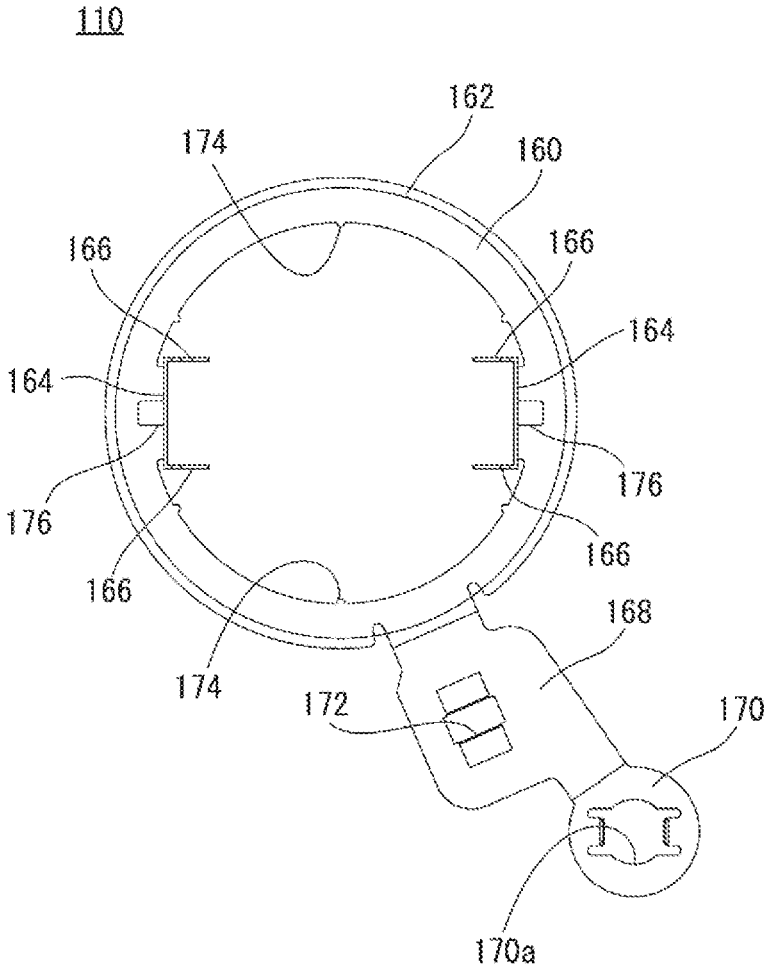
FIG. 9 is a front view illustrating a contact terminal.
Figure 10:
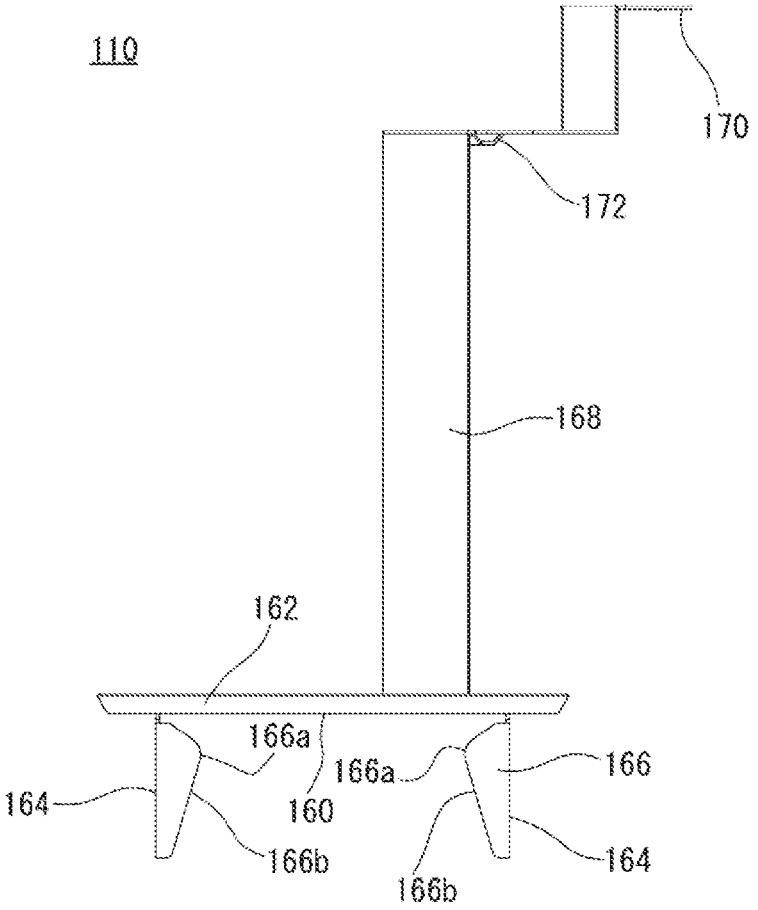
FIG. 10 is a plan view illustrating the contact terminal.
Figure 11:
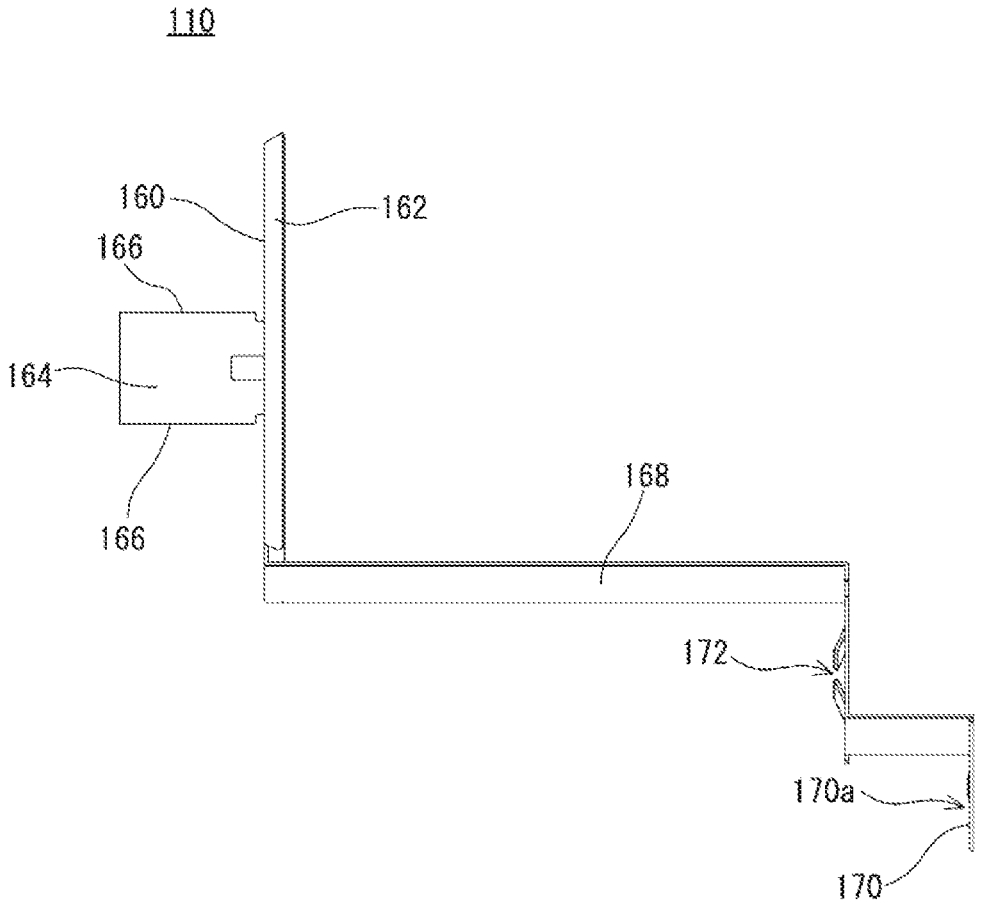
FIG. 11 is a side view illustrating the contact terminal.

With reference to FIG. 6, FIG. 7, and FIG. 8, the support holder 108 is a holding member for positioning the photoreceptor drum 36 and is made of the non-conductive synthetic resin. The support holder 108 includes: an outer cylinder 130 in a cylindrical shape that covers an outer circumferential surface of the boss 120 of the drum drive gear 106; and a substantially disc-shaped flange 132 that expands outward from a base end (a rear end) of the outer cylinder 130. The flange 132 is formed with plural insertion holes 134 (a total of three at upper, lower-left, and lower-right positions of the outer cylinder 130), through each of which a screw 140 is inserted. When each of the screws 140 is threaded into a screw hole 142, which is formed in the inner plate 102*b*, via this insertion hole 134, the support holder 108 is fixed to the inner plate 102*b*. In addition, the flange 132 is formed with a retainer pin 136 at a lower right position of the outer cylinder 130.

The drum shaft positioner 150 is formed at a tip (a front end) of the outer cylinder 130. The drum shaft positioner 150 has a cylinder 152 that is formed concentrically with an axial center of the gear support shaft 104 (that is, an axial center of the drum drive gear 106) and is externally fitted to the second bearing 82. That is, an inner circumferential surface of the cylinder 152 is a first fitting surface that is fitted to an outer circumferential surface of the second bearing 82. In the cylinder 152 of this drum shaft positioner 150, the support holder 108 rotatably supports the rear end of the drum shaft 76 of the photoreceptor drum 36 via the second bearing 82 (see FIG. 15). In this way, the photoreceptor drum 36 (and thus the entire process unit 70) is positioned, and thus the drum drive gear 106 and the drum shaft 76 of the photoreceptor drum 36 are appropriately and axially aligned.

In the cylinder 152 of the drum shaft positioner 150, plural slits 154 are formed to extend axially from a tip of the cylinder 152 toward a rear end side thereof. In this embodiment, the cylinder 152 is formed with pairs of the two slits 154 aligned at a predetermined interval therebetween in a circumferential direction, and the pairs are provided at mutually opposing positions across an axial center of the cylinder 152. In other words, the cylinder 152 has the two pairs of the slits 154 (that is, a total of the four slits 154) that mutually oppose across the axis center.

At a base end (a rear end) of the cylinder 152, a diameter of the cylinder 152 is increased in a stepped manner, and a ring-shaped butting member 156 that expands outward is formed on an outer circumferential surface at the base end of the cylinder 152. In addition, at each of mutually opposing positions in the butting member 156 across the axial center of the cylinder 152, a positioning boss 158 is formed to be projected forward.

In this embodiment, the contact terminal 110 is attached to the outer circumferential surface side of the cylinder 152 of the drum shaft positioner 150. A specific description will hereinafter be made on a configuration of the contact terminal 110.

With reference to FIG. 6, FIG. 7, and FIG. 9 to FIG. 11, the contact terminal 110 has a circular plate-shaped annular plate 160 that is externally fitted to the base end of the cylinder 152 of the drum shaft positioner 150 and abuts the butting member 156. On an outer circumferential surface of the annular plate 160, a short cylindrical skirt 162 is formed to be externally fitted to the outer cylinder 130. In addition, on an inner circumferential surface of the annular plate 160, at mutually opposing positions across the axial center of the cylinder 152, a pair of arms 164 is formed along the outer circumferential surface of the cylinder 152. Each of the paired arms 164 is formed in a rectangular plate shape that extends from the inner circumferential surface of the annular plate 160 toward the tip side of the cylinder 152 and extends in the axial direction of the cylinder 152. This arm 164 is elastically deformable in a direction that intersects the axial direction of the cylinder 152 (in a radial direction of the cylinder 152) with respect to the annular plate 160 with a coupled portion to the annular plate 160 being a fulcrum. Here, since the cylinder 152 is externally fitted to the second bearing 82, the axial direction, the radial direction, the circumferential direction, and the axial center of the cylinder 152 respectively match the axial direction, the radial direction, the circumferential direction, and the axial center of the second bearing 82.

Each of the paired arms 164 is formed with the abutment piece 166 in a substantially triangular plate shape that extends from both sides of the arm 164 (that is, at a specified distance being provided in the circumferential direction of the cylinder 152) toward the axial center side of the cylinder 152. That is, in this embodiment, on the inner circumferential surface of the annular plate 160, a pair of the two arms 164 circumferentially aligned at a predetermined interval is formed at mutually opposing positions across the axial center of the cylinder 152. Each of the abutment pieces 166 is inserted in the respective slit 154 formed in the cylinder 152, and a tip (an abutment 166*a*) thereof is exposed to the inner circumferential surface side of the cylinder 152 and abuts the outer circumferential surface of the second bearing 82. A projection height of the abutment piece 166 from the arm 164 is greater than a thickness of the cylinder 152, and the abutment 166*a* of the abutment piece 166 with respect to the second bearing 82 is projected inward from the inner circumferential surface of the cylinder 152. In addition, at a tip of the abutment piece 166, an inclined portion 166*b* is formed on a front side of the abutment 166*a*. The inclined portion 166*b* is inclined toward the annular plate 160 side (the rear side) in a direction toward the axial center. Here, the abutment 166*a* is formed on the annular plate 160 side (the rear side) from a center of the abutment piece 166 in the axial direction of the cylinder 152. In this way, it is possible to reduce an inclination angle of the inclined portion 166*b* and to reduce insertion resistance at the time of inserting the second bearing 82 in the cylinder 152.

On the outer circumferential surface of the annular plate 160, an extension 168 is formed to extend through the outer circumferential surface of the outer cylinder 130 to one of the insertion holes 134 (in this embodiment, the lower right insertion hole 134) that are formed in the flange 132. A circular plate-shaped fixture 170 having an insertion hole 170*a* is formed at a tip of the extension 168. In addition, a retaining hole 172, into which the retainer pin 136 formed in the flange 132 of the support holder 108 is press-fitted, is formed at a center of the extension 168.

Furthermore, on the inner circumferential surface of the annular plate 160, plural (six in this embodiment) retaining projections 174 are formed at predetermined intervals in the circumferential direction, and are pressed against the outer circumferential surface of the cylinder 152. Moreover, on the inner circumferential surface of the annular plate 160, plural (two in this embodiment) positioning holes 176, into each of which the positioning boss 158 formed in the butting member 156 is fitted, are formed.

Figure 12:
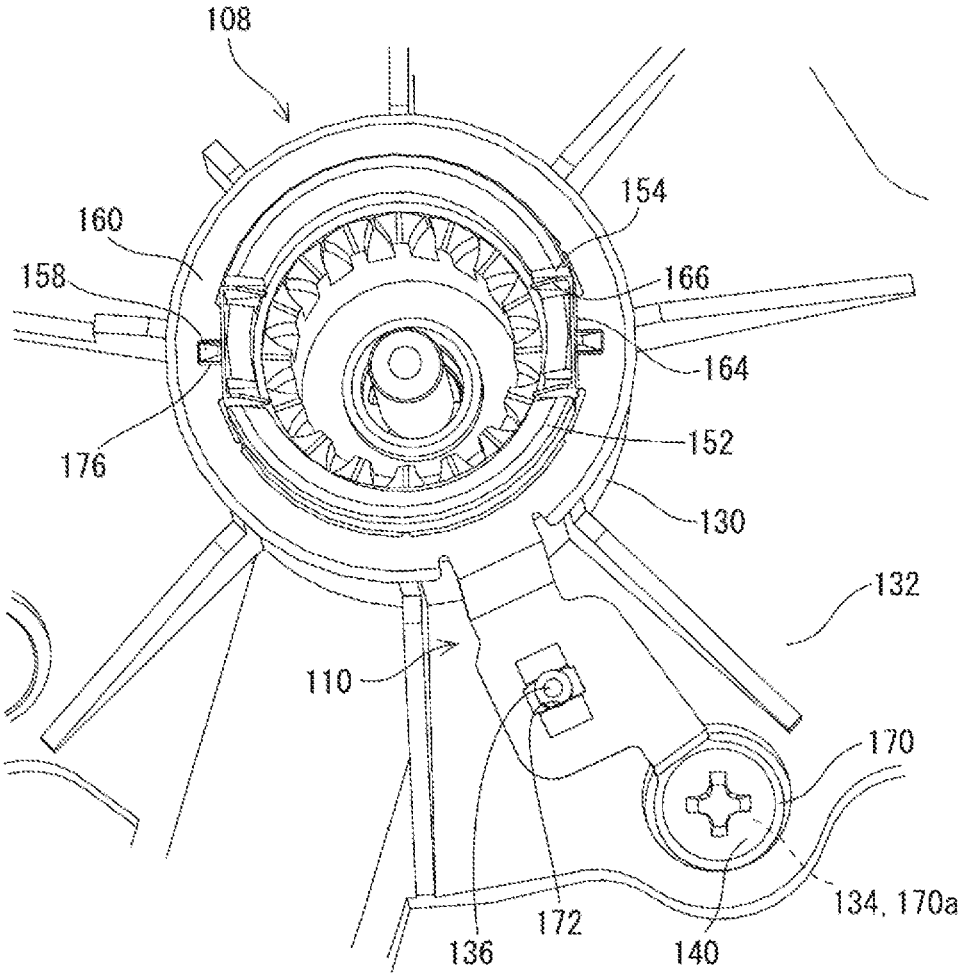
FIG. 12 is a perspective view illustrating peripheral components of the contact terminal in the process unit drive device.

When such a contact terminal 110 is attached to the outer circumferential surface side of the cylinder 152, as illustrated in FIG. 6, FIG. 7, and FIG. 12, the annular plate 160 is fitted from the tip side of the cylinder 152 to make the annular plate 160 abut the butting member 156, and the abutment piece 166 is inserted in the slit 154. At this time, the retaining projections 174 formed on the inner circumferential surface of the annular plate 160 press the outer circumferential surface at the base end of the cylinder 152, and thereby retains the contact terminal 110 (in particular, the annular plate 160). Then, the positioning boss 158 is fitted into the positioning hole 176, and the retainer pin 136 is press-inserted in the retaining hole 172. In this way, a circumferential position (angle) of the contact terminal 110 is set, and the contact terminal 110 (in particular, the extension 168) is retained. Furthermore, the insertion hole 170*a* of the fixture 170 is made to overlap the lower-right insertion hole 134, and the screw 140 is threaded to the screw hole 142, which is formed in the inner plate 102*b*, via these insertion holes 134, 170*a*. In this way, the support holder 108 is fixed to the inner plate 102*b*, and the contact terminal 110 is fixed to the support holder 108. At this time, the conductive screw 140 electrically connects the extension 168 of the contact terminal 110 to the inner plate 102*b*, and the contact terminal 110 is grounded via the inner plate 102*b*.

Figure 14:
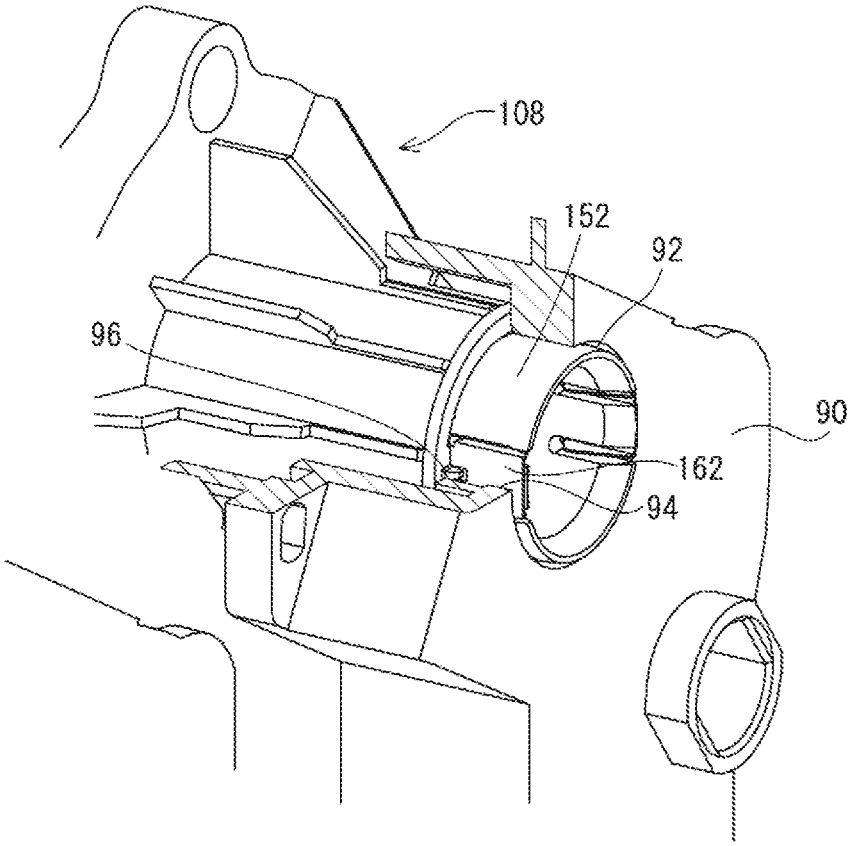
FIG. 14 is a view illustrating peripheral components of the support holder in the process unit drive device in an attached state to the body frame.

As described above, the process unit drive device 100 including such a contact terminal 110 is fixed to the body frame 90. As illustrated in FIG. 13 and FIG. 14, the body frame 90 is made of the non-conductive synthetic resin, and the body frame 90 is formed with an outer fitter 92, into which the cylinder 152 of the drum shaft positioner 150 is fitted. That is, the outer circumferential surface of the cylinder 152 is a second fitting surface that is fitted to an inner circumferential surface of the outer fitter 92. On the inner circumferential surface of the outer fitter 92, an opening restrictor 94 is formed to restrict outward opening of the arm 164 of the contact terminal 110. In addition, on an end surface of the outer fitter 92 on a side opposing the annular plate 160, a removal restrictor 96 is formed to restrict movement of the annular plate 160 in a removal direction.

In the image forming apparatus 10 as described above, as shown in FIG. 15, when the process unit 70 is attached to the apparatus body 12, the process unit 70 is coupled to the process unit drive device 100. More specifically, the photoreceptor coupling 80 is fitted to the drive coupling 124, and the second bearing 82, which is attached to the drum shaft 76 of the photoreceptor drum 36, is fitted to the drum shaft positioner 150 of the support holder 108. In this way, the photoreceptor drum 36 is positioned by the support holder 108 and the second bearing 82. Then, the rotary drive power from the drive motor is transmitted to the drum shaft 76 of the photoreceptor drum 36 via the drum drive gear 106, and the photoreceptor drum 36 is thereby rotationally driven in a predetermined direction.

Furthermore, when the second bearing 82 is fitted to the cylinder 152 of the drum shaft positioner 150, the abutment 166*a* of the abutment piece 166 in the contact terminal 110 abuts the outer circumferential surface of the second bearing 82, and the drum shaft 76 of the photoreceptor drum 36 and the contact terminal 110 are electrically connected via the second bearing 82 (that is, the conduction mechanism 200 is connected). At this time, since the abutment 166*a* of the abutment piece 166 is projected inward from the inner circumferential surface of the cylinder 152, the second bearing 82 presses the abutment piece 166, and the abutment piece 166 is elastically deformed in a direction in which the arm 164 is opened outward. In this way, in a state where the abutment piece 166 is urged to the second bearing 82 side, the abutment 166*a* of the abutment piece 166 contacts the outer circumferential surface of the second bearing 82 at a predetermined pressure. In addition, since the opening restrictor 94 is formed on the inner circumferential surface of the outer fitter 92, it is possible to prevent the arm 164 from being excessively opened outward.

As it has been described so far, according to this embodiment, since the abutment piece 166 of the contact terminal 110 is brought into contact with the outer circumferential surface of the second bearing 82 from the slit 154 formed in the cylinder 152 of the drum shaft positioner 150, it is possible to secure high positioning accuracy of the contact terminal 110. Therefore, it is possible to secure stable conduction to the drum shaft 76 without performing special processing on the second bearing 82 as a contact object by the contact terminal 110.

In addition, since the second bearing 82 is used as one of the conductive members and the abutment piece 166 of the contact terminal 110 is brought into contact with the outer circumferential surface of the second bearing 82, a sliding portion in the conduction mechanism 200 serves as a contact surface between the drum shaft 76 and the second bearing 82. As a result, a problem of scraping of the sliding portion is solved, and the conduction to the drum shaft 76 can be stabilized. In addition, since the second bearing 82 is applied with, in addition to own weight of the process unit 70, a pressurizing force from the intermediate transfer roller 60 in the radial direction, it is possible to appropriately secure the pressurizing force onto the sliding portion (the contact surface between the drum shaft 76 and the second bearing 82).

Furthermore, since the annular plate 160 of the contact terminal 110 is held and fixed between the butting member 156 of the drum shaft positioner 150 and the removal restrictor 96 of the body frame 90, it is possible to appropriately prevent the contact terminal 110 from moving in conjunction with removal of the process unit 70.

In the above-described embodiment, the slide bearing is used as the second bearing 82 as an example of the bearing. However, the second bearing 82 may be a rolling bearing (a ball bearing).

In addition, at least one each of the slit 154 of the cylinder 152 and the abutment piece 166 of the contact terminal 110 only needs to be provided. The configuration such as the number, the shape, and the arrangement position of each of the slit 154 of the cylinder 152 and the abutment piece 166 of the contact terminal 110 can appropriately be changed.

Furthermore, in the above-described embodiment, as the image forming apparatus 10, the multifunction peripheral in which a copier, a facsimile machine, a printer, and the like are combined is exemplified. However, the image forming apparatus 10 may be a multifunction peripheral in which any of or at least two of the copier, the facsimile machine, the printer, and the like are combined.

Moreover, in the above-described embodiment, the conduction mechanism 200 is applied to the drum shaft 76 of the photoreceptor drum 36. However, the conduction mechanism 200 can also be applied to another conductive member in the image forming apparatus 10. For example, the conduction mechanism 200 can be applied to a conductive member in the secondary transfer roller 44 or the paper stop roller 68. In addition, the conduction mechanism 200 can be applied not only to a grounding conductive member but also to a conductive member to supply electricity. Furthermore, the conduction mechanism 200 can be applied to a conductive member provided to a device other than the image forming apparatus 10.

The specific numerical values, component shapes, and the like described above are mere examples, and can appropriately be changed according to need such as a product specification.

What is claimed is:

1. A conduction mechanism that electrically connects a contact terminal to a rotary shaft, the conduction mechanism comprising:

a conductive bearing that rotatably supports the rotary shaft;

a non-conductive axial positioner that has a cylinder externally fitted to the bearing; and the contact terminal that is attached to an outer circumferential surface side of the cylinder, wherein the axial positioner has a slit that is formed in the cylinder, and the contact terminal has an abutment piece that is exposed to an inner circumferential surface side of the cylinder from the slit and abuts an outer circumferential surface of the bearing.

2. The conduction mechanism according to claim 1, wherein the axial positioner has a pair of the slits, the slits being formed at mutually opposing positions across an axial center of the cylinder, and the contact terminal has a pair of the abutment pieces respectively arranged to the pair of the slits.

3. The conduction mechanism according to claim 2, wherein the axial positioner has an annular butting member that is formed to expand outward from an outer circumferential surface at a base end of the cylinder, and the contact terminal has an annular plate that abuts the butting member.

4. The conduction mechanism according to claim 3, wherein the contact terminal has an arm that extends in an axial direction of the cylinder from an inner circumferential surface of the annular plate and is formed to be elastically deformable in a direction that intersects the axial direction with respect to the annular plate, and the abutment piece extends from the arm toward the axial center side of the cylinder.

5. The conduction mechanism according to claim 4, wherein the arm is formed with the plural abutment pieces at predetermined intervals in a circumferential direction of the cylinder.

6. The conduction mechanism according to claim 4 further comprising:

an outer fitter that is externally fitted to the cylinder, wherein the outer fitter has an opening restrictor that is formed on an inner circumferential surface of the outer fitter and restricts outward opening of the arm.

7. The conduction mechanism according to claim 6, wherein the outer fitter has a removal restrictor that is formed on an end surface of the outer fitter on a side opposing the annular plate and restricts movement of the annular plate in a removal direction.

8. The conduction mechanism according to claim 3, wherein the contact terminal has a retaining projection that is projected from an inner circumferential surface of the annular plate and is pressed against the outer circumferential surface of the cylinder.

9. An image forming apparatus comprising:
the conduction mechanism according to claim 1.

* * * * *